US009596936B2

(12) United States Patent
Bahneman et al.

(10) Patent No.: US 9,596,936 B2
(45) Date of Patent: Mar. 21, 2017

(54) SEATING DEVICE

(71) Applicant: SitTight, Inc., Newport Beach, CA (US)

(72) Inventors: Scott Bahneman, Newport Beach, CA (US); Tim Pratt, San Anselmo, CA (US); Filip Trojanek, San Rafael, CA (US)

(73) Assignee: SiTight, Inc., Newport Beach, CA (US)

( * ) Notice: Subject to any disclaimer, the term of this patent is extended or adjusted under 35 U.S.C. 154(b) by 0 days.

(21) Appl. No.: 14/679,381

(22) Filed: Apr. 6, 2015

(65) Prior Publication Data

US 2015/0208807 A1 Jul. 30, 2015

Related U.S. Application Data

(63) Continuation of application No. 13/527,567, filed on Jun. 19, 2012, now Pat. No. 8,998,319.

(51) Int. Cl.
*A47C 3/029* (2006.01)
*A47C 9/00* (2006.01)

(52) U.S. Cl.
CPC ..... *A47C 3/029* (2013.01); *A47C 9/00* (2013.01); *A47C 9/002* (2013.01)

(58) Field of Classification Search
USPC ..... 297/195.11, 461, 451.4, 451.5, 270.3, 297/270.5, 271.5, 214, 195.1, 270.1
See application file for complete search history.

(56) References Cited

U.S. PATENT DOCUMENTS

| | | | | | |
|---|---|---|---|---|---|
| 2,038,806 | A * | 4/1936 | Sellar | 248/398 |
| 2,988,358 | A * | 6/1961 | Mills | 472/135 |
| 3,312,437 | A * | 4/1967 | Barth | 248/158 |
| 3,911,509 | A * | 10/1975 | Fleckenstein | 5/507.1 |
| 4,130,263 | A * | 12/1978 | Roericht | 248/371 |
| 4,865,382 | A * | 9/1989 | Marshall | 297/195.11 |
| 5,112,103 | A * | 5/1992 | Downer | 297/270.1 |
| 5,853,219 | A * | 12/1998 | Santuccio | 297/5 |
| 6,179,376 | B1 * | 1/2001 | Meeker et al. | 297/137 |
| 6,336,235 | B1 * | 1/2002 | Ruehl | 5/610 |
| D454,438 | S * | 3/2002 | Volkman et al. | D6/349 |
| 6,976,699 | B2 * | 12/2005 | Koerlin | 280/650 |

(Continued)

FOREIGN PATENT DOCUMENTS

DE 3201335 A1 * 7/1983 ..... A47C 9/10

*Primary Examiner* — David E Allred
(74) *Attorney, Agent, or Firm* — Smyrski Law Group, A P.C.

(57) ABSTRACT

A seating device is provided. The seating device includes a seat, a post positioned below and attached to the seat, a base positioned below and attached to the post, an inflatable bladder positioned below and attached to the base, sensing electronics configured to sense orientation of the seating device and provide orientation data to a remote computing device, and a guard attached to the base. The guard includes a cylindrical wall centered on a longitudinal axis of the post and extending downward from the base at a position spaced radially outward from the inflatable bladder. The inflatable bladder includes a complete spherical dome wherein when the inflatable bladder is filled, a tangent line to the inflatable bladder intersects the lower edge and forms an angle of greater than or equal to about 75 degrees relative to the post.

20 Claims, 6 Drawing Sheets

(56) References Cited

U.S. PATENT DOCUMENTS

| | | | | |
|---|---|---|---|---|
| 7,156,790 | B2 * | 1/2007 | Johnsen | 482/146 |
| 7,374,517 | B2 * | 5/2008 | Lockett | 482/131 |
| 7,775,952 | B1 * | 8/2010 | Curran et al. | 482/146 |
| 7,922,134 | B2 * | 4/2011 | Gasser | 248/129 |
| 8,977,441 | B2 * | 3/2015 | Grimes et al. | 701/50 |
| 2005/0121959 | A1 * | 6/2005 | Kruse et al. | 297/330 |
| 2007/0120404 | A1 * | 5/2007 | Bellows et al. | 297/256.16 |
| 2007/0138850 | A1 * | 6/2007 | Oettinger | 297/271.5 |
| 2008/0097256 | A1 * | 4/2008 | Torres et al. | 601/24 |
| 2008/0191525 | A1 * | 8/2008 | Jensen et al. | 297/217.2 |
| 2009/0001788 | A1 * | 1/2009 | Lenz et al. | 297/217.4 |
| 2009/0058151 | A1 * | 3/2009 | Zoell | 297/130 |
| 2013/0193729 | A1 * | 8/2013 | VanMiddendorp et al. | 297/311 |
| 2013/0288866 | A1 * | 10/2013 | Rainey | 482/146 |
| 2014/0103687 | A1 * | 4/2014 | Carlson et al. | 297/284.1 |

* cited by examiner

SEATING DEVICE

This application is a continuation of U.S. patent application Ser. No. 13/527,567, filed Jun. 19, 2012, entitled "Seating Device", inventors Scott Bahneman et al., the entirety of which is incorporated herein by reference.

BACKGROUND

I. Field

The present invention relates generally to seating, and more specifically a seating device that requires balancing and coordination on the part of its user.

II. Background

Previously available seating devices such as chairs and couches offer elements, such as legs, that fix the sitting surface or seat at a distance above a floor. Such devices enable a user to sit comfortably on a stable surface.

Studies have found that in certain instances, sitting on a device that is not stable can be beneficial. For example, persons having difficulty concentrating or focusing their attention can be aided by a chair or device that requires some level of physical interaction on the part of the user, such as balancing. A traditional chair, with a relatively fixed sitting surface, can be inadequate in situations where the user tends to have lapses in concentration after periods of time.

Previous designs have sought to address this need, including but not limited to use of balls or alternate solutions such as standing desks. Each of these solutions has its own issues. Sitting on a ball can cause the user to reach a "balancing point" such that no further balancing or movement is required. The need for continuously adjusting balance can be very beneficial. Standing desks do not truly address the issue, and are more for persons with back issues. Use of standing desks does not necessarily help with concentration, as a user can attain a balanced position and hold it for an extended period of time.

Certain devices seeking to address this issue have been produced or suggested. One such example is disclosed in U.S. Pat. No. 7,156,790 to Johnsen. Johnsen offers a training apparatus/chair said to provide exercise for the back, having a circular chair seat 1 with a tilting means 4 and a damping means 5. Johnsen requires bottom plate 7, a large plate that makes the device cumbersome and difficult to relocate. With respect to the tilting means, the material of the tilting means 4 is not specified, but appears to be a fixed, unalterable semicircular piece. The damping means 5 is said to stabilize the chair such that it is possible to maintain balance, apparently strengthening the musculature of the back. The damping means add to the cumbersome nature of the device and are apparently needed because the tilting means 4 can cause the device to attain an unacceptable angle and cause the user to fall off the circular seat 1. A second embodiment of Johnsen shows no bottom plate, but instead a cloth filled by damping means. It is unclear what angle the circular seat could attain using this pliable damping means, and if a tall and/or heavy user could be subjected to movement perceived to be a threat to dislodge the user from the device.

The problems with Johnsen include the seat, which could easily cause the user to slip, the fixed and unchangeable nature of the tilting means 4, and the need for the cumbersome bottom plate 7 and/or pliable damping means seeking to prevent the user from falling off.

It has been found that certain dimensions in a seating device similar to that disclosed in Johnsen can be critical. The user should constantly be challenged, but have minimal risk of falling off such a device, and the device should accommodate a majority if not all of the population. Certain negative attributes of the Johnsen device call for improvements that minimize the risks and unwieldy nature of the device.

Therefore, there is a need for a seating device that enables the user to continually rebalance himself or herself that improves on previous designs and is usable by a wide segment of the population.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its sole purpose is to present some concepts in a simplified form as a prelude to the more detailed description that is presented later.

The present invention includes a seating device including a seat, a post positioned below and attached to the seat, a base positioned below and attached to the post, an inflatable bladder positioned below and attached to the base, sensing electronics configured to sense orientation of the seating device and provide orientation data to a remote computing device, and a guard attached to the base. The guard includes a cylindrical wall centered on a longitudinal axis of the post and extending downward from the base at a position spaced radially outward from the inflatable bladder. The guard has a lower edge located above a bottom of the inflatable bladder and configured to inhibit tipping of the seat to no more than ten degrees from horizontal. The inflatable bladder includes a complete spherical dome wherein when the inflatable bladder is filled, a tangent line to the inflatable bladder intersects the lower edge and forms an angle of greater than or equal to about 75 degrees.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

In designing a seat usable to help a user continually maintain balance and concentration while sitting, the inventors have found that providing a small amount of tipping of the user's center of gravity is of great importance, and a device that provides only a small amount of tipping is particularly beneficial. Size of the device, including relative dimensions and proportions, including proportional considerations relative to a user's center of gravity, are of particular interest. Such a device can provide concentration benefits as well as cardiovascular benefits not shown by previous devices, where maintaining balance for a long period of time can provide a cardiovascular workout for the user.

Figure 1:
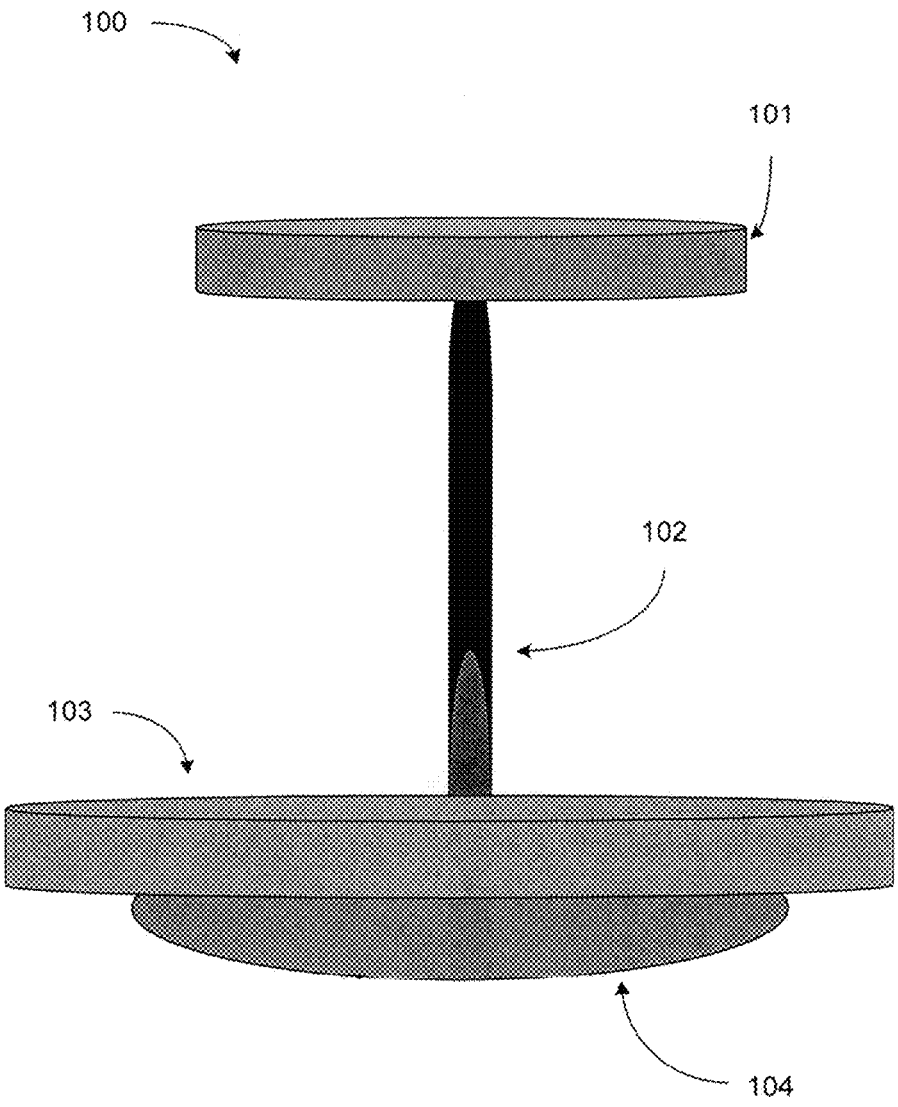
FIG. 1 is a general depiction of a side view of a first embodiment of the present design.

FIG. 1 illustrates a basic embodiment of the present design. In FIG. 1, seating device 100 includes seat 101, providing a general sitting surface positioned above adjustable post 102. Seat 101 may be any type of seat, such as a bicycle seat or a flat type of seat with foam or some other soft material provided thereon. One example of a bicycle type seat is presented in the second embodiment illustrated in, for example, FIG. 2. Adjustable post 102 may be adjusted up or down using any type of adjustment mechanism known in the art, such as a multiple element post with a pin, or a screw height adjustment, or otherwise. Adjustable post 102 is fixedly mounted to footrest 103, also called a base, which is adjacent inflatable bladder 104. Footrest or base 103 provides a place for the user to place his or her feet, while inflatable bladder provides a pliable base on which all of the components rest.

As shown in FIG. 1, the inflatable bladder 104 has some degree of curvature and covers a significant portion of the bottom of footrest 103. In general, to prevent overtipping and to maintain a generally constant requirement for the user to balance with his or her feet on footrest 103. In general, the diameter of inflatable bladder 104 is greater than 60 percent of the diameter of footrest 103, but other percentages, such as 70, 75, or even 80 percent or more may be offered. In no case is less than 35 percent of the underside of the base/footrest taken up by the inflatable bladder 104, either in diameter or in area. In certain instances, less than 40 or even 50 percent of the underside of the base may be taken up by inflatable bladder 104. Of particular note is the ability to provide for a small angular amount of tipping of the seat while at the same time providing continuous imbalance for the user.

Further, inflatable bladder 104 may be equipped with a fill/deflate mechanism (not shown) to enable the user or some other person to increase the amount of pressure in inflatable bladder 104. The fill/deflate mechanism may be provided with the footrest or base or may be provided in the exterior of the inflatable bladder 104. The fill/deflate mechanism may enable a user to fine tune the amount of tipping needed, or the resistance required, to provide the requisite level of constant imbalance of the seating device without risk of tipping over, or more importantly, the user perceiving she faces the threat of tipping over. A seat tipping of less than 5 degrees or possibly less than 15 degrees from the horizontal can be desirable. The fill/deflate mechanism may be any type of fill mechanism known to those in the art that may be employed for the purpose shown, including but not limited to a closable valve able to be employed with a standard bicycle pump. A pressure gauge may also be provided such that the user may determine the amount of pressure in the inflatable bladder 104, such as in or attached to base 103. A visible indication may be provided, or alternately transmission of pressure information, such as by wireless signal, which may be viewable by the user on an external device, such as a computer, smartphone, or other appropriate device.

The construction of the inflatable bladder 104 is therefore a rubber, rubberized, or other flexible material. The ability for the base of the device to provide some level of resistance but some level of pliability is of particular interest. A hard base could provide the user with a level of unease when the device tips in a particular direction. The inflatable bladder 104 is typically filled with air, but any gas may be employed.

Figure 2:
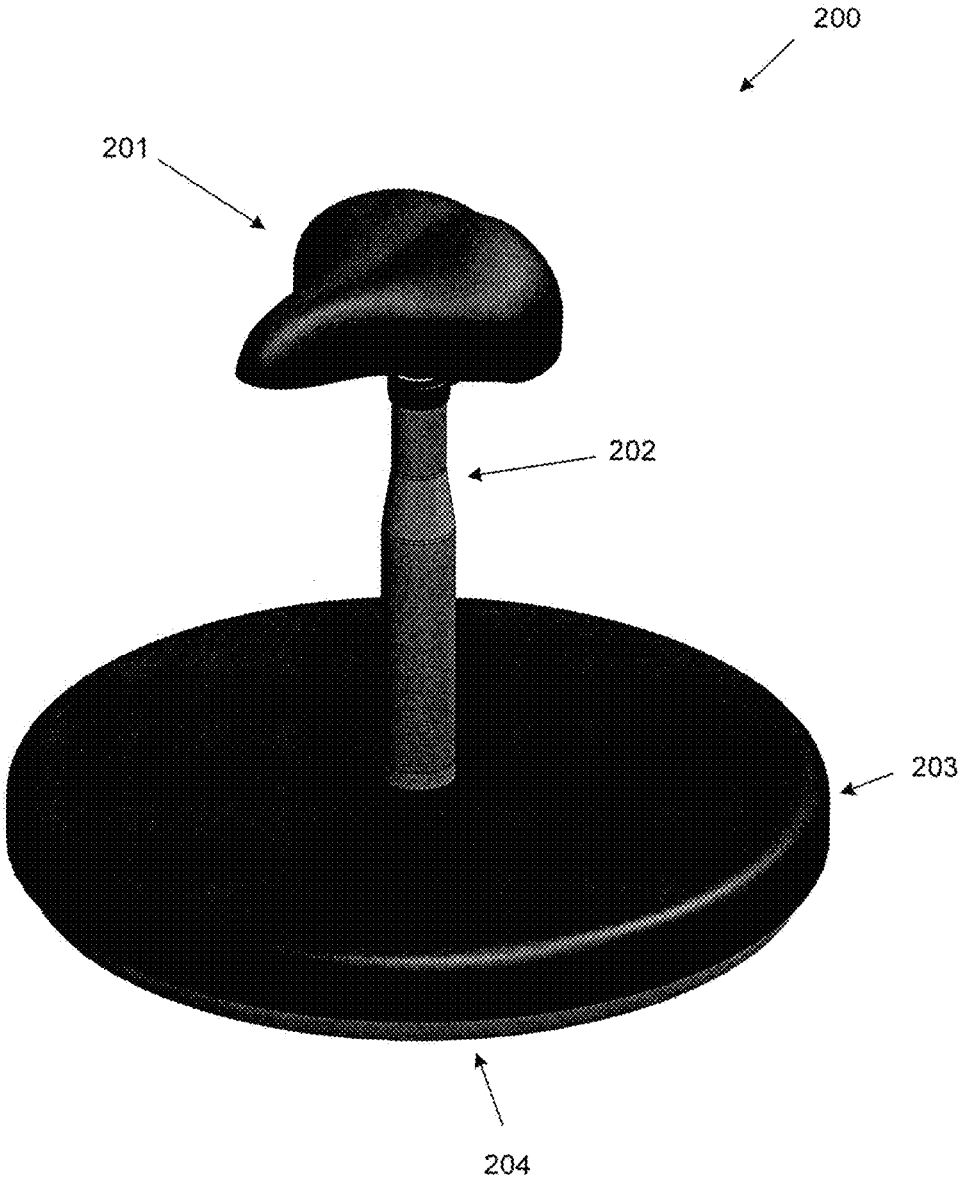
FIG. 2 is a top perspective view of a further embodiment of the present design.

FIG. 2 illustrates an alternate embodiment of the present design. Seating device 200 includes seat 201, which may be a conventional bicycle saddle-type seat, and hardware for changing the seat may be employed. Hardware for changing the seat may be hardware provided with modern conventional bicycles, enabling the user or some other person to simply release circular pressure on the seat post, remove the old seat, insert the new seat, and tighten or increase circular pressure or remove the seat and/or any associated hardware in a conventional manner, i.e. a manner known in the art. However, any type of seat attachment hardware known to those skilled in the art may be employed.

Post 202 can be adjusted to provide varying distances between footrest 203 and seat 201 to a comfortable level for virtually any user. Any adjustment mechanism for such a design known to those skilled in the art may be employed, including but not limited to a two-cylinder arrangement, with an inner cylinder and an outer cylinder, with either a locking mechanism or pin provided. Footrest 203 includes in this embodiment a shield or guard 204, forming in this embodiment a circle around and inside the footrest 203. The shield or guard 204 prevents excessive tipping while at the same time providing a sense of tipping for the user. Again, it is desired for the user to maintain balance without excessive movement of the footrest 203 or seat 201.

An alternate implementation of post 202 is a telescoping cylinder arrangement known in the art of seating devices, with a switch enabling the user to raise or lower the seat as desired. Such operation is typically pneumatic but can include any type of appropriate raising and lowering mechanism.

Figure 3:
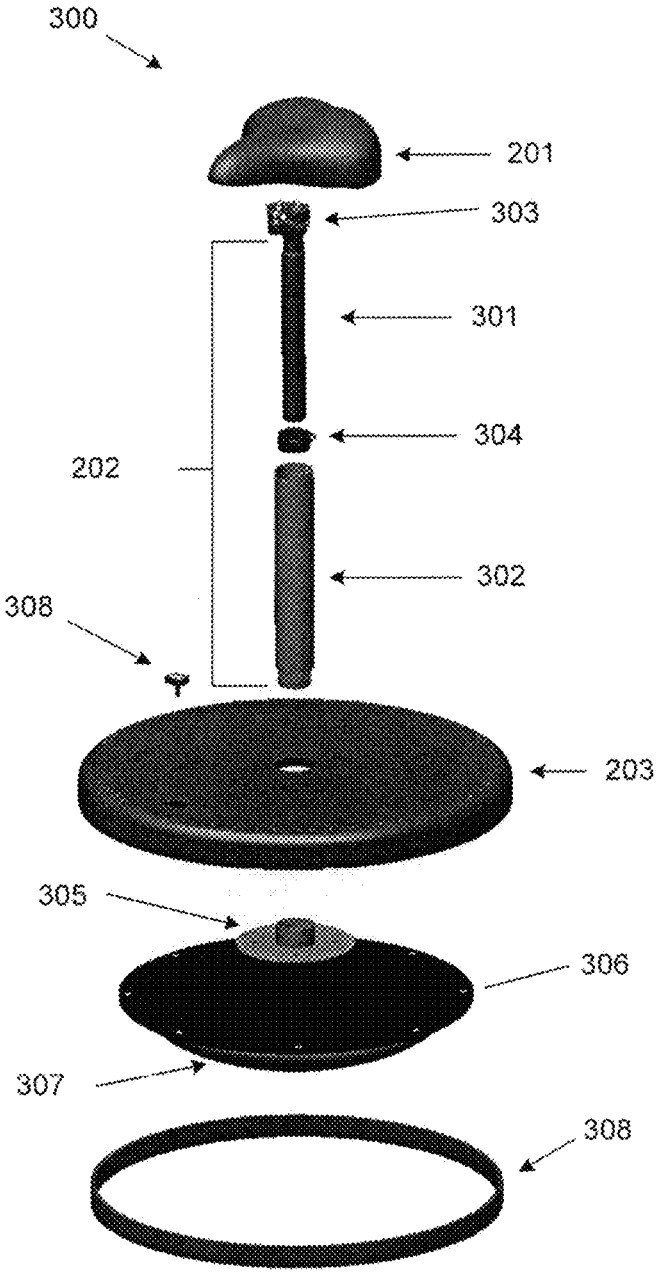
FIG. 3 is an exploded view illustrating the components of an embodiment of the present design.

Not shown in FIG. 2 is the inflatable bladder acting as a resistive element at the base of the footrest 203. FIG. 3 illustrates an exploded view of the design, wherein seating device 300 includes seat 201, post 202 comprising inner post piece 301 and outer post piece 302, footrest 203, shield 204, and includes addition pieces such as seat mounting hardware 303, tightening ring 304, threaded mounting piece 305, bladder attachment piece 306, and inflatable bladder 307.

Note that in this view, no fill mechanism is provided for inflatable bladder 307. Element 308 represents hardware provided in the footrest 203 that can serve to provide an insignia or label. However, element 308 could be replaced with a fill mechanism or bladder filling hardware, or such hardware could be provided elsewhere on the seating device 300.

Seat 201 attaches to seat mounting hardware 303, which is fixedly mounted atop inner post piece 301. Inner post piece 301 slides within outer post piece 302 and is affixed at a desired height using tightening ring 304. The bottom of outer post piece 302 is threaded in order to engage threaded mounting piece 305. Any type of threading may be employed, or other securing means such as pins, bolts, and so forth may be used to secure the post 202 to the footrest 203. As shown, threaded mounting piece 305 includes openings to bolt the piece to bladder attachment piece 306. Bladder attachment piece 306 includes various holes for connection of the inflatable bladder 307 to the bladder attachment piece 306. Shield or guard 204 is attached to footrest 203 using conventional means and keeps the user from tipping excessively.

Figure 4:
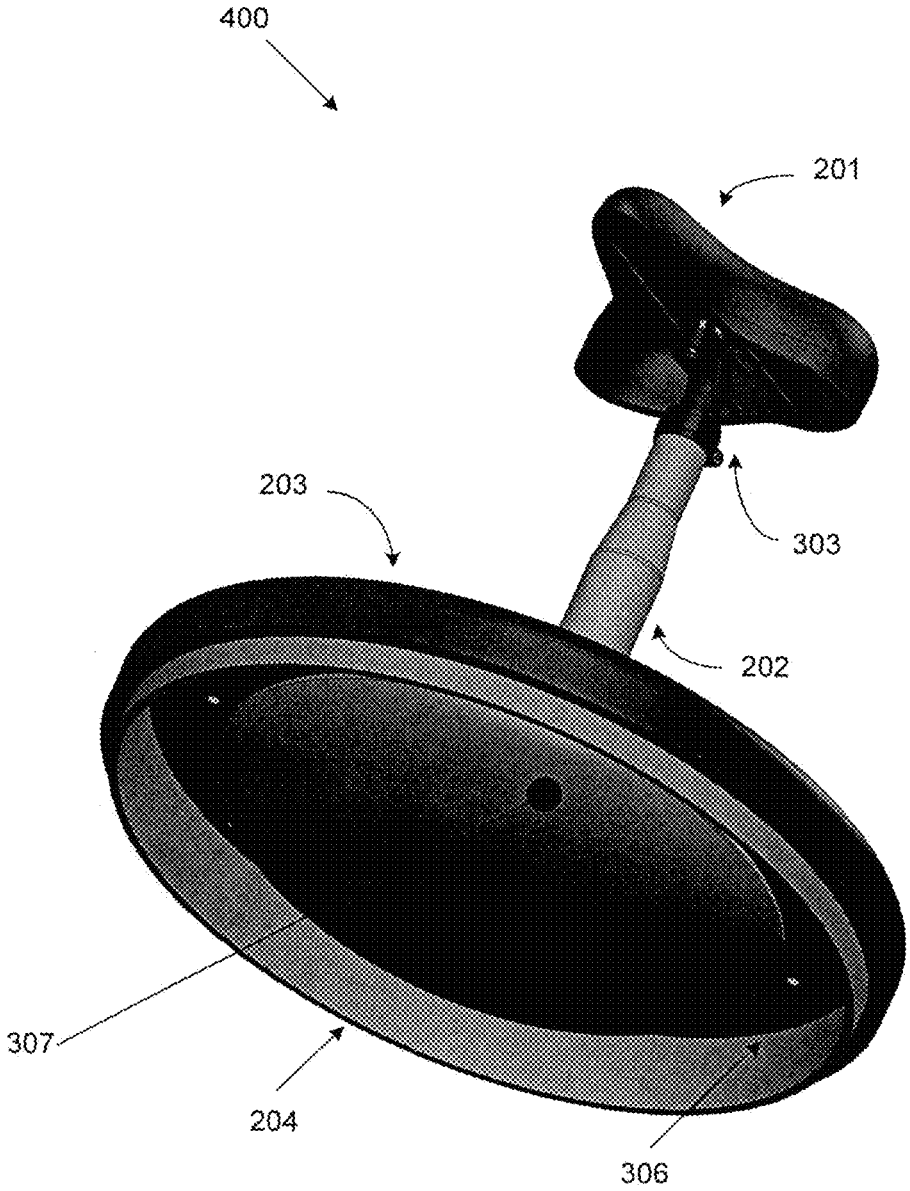
FIG. 4 is a bottom perspective view of a third embodiment of the present design.

FIG. 4 illustrates an underside view of the second embodiment in perspective view. Footrest 203 has shield or guard 204 positioned therein, and inflatable bladed 307 is attached to bladder attachment piece 306.

Dimensions of this FIG. 4 embodiment are of particular note. In seating device 400, inflatable bladder 307 is typically a portion of a sphere, but other shapes may be employed. To keep the user from excessively tipping, inflatable bladder 307 is relatively wide, and its diameter takes up the majority of the underside of footrest 203. If inflatable bladder 307 is a part of a sphere, it typically constitutes less than 35 percent of the sphere. The radius of curvature of inflatable bladder 307 is significant, and may be as large as two to three feet, but generally between 0.5 feet and four feet. In simple terms, the radius of curvature greater than 0.5 feet but less than four feet. The inflatable bladder occupies over 35 percent of the surface area of the footrest 203, and can be over 66 percent or even 75 percent. Of particular interest is the relationship between shield 204 and inflatable bladder 307. The inflatable bladder extends slightly below the lowest edge of the inflatable bladder 307 when the device is in an upright position. A clearance of, for example, one and a half to two inches may be provided between shield 204 and a surface such as a floor (not shown), but other dimensions may be used, particularly if the user elects to pump air to or expel air from inflatable bladder 307.

Such a short throw or clearance from the floor coupled with the broad, gentle curvature of the inflatable bladder provides enough resistance and enough of an imbalance to enable the user to continually balance on the device while at the same time providing a gentle barrier such that the user is not threatened with falling off, and quick, concerning movements are not made when the user leans in one direction or another. A relatively short clearance between the floor and the shield or guard limits the amount the user can tip in the worst case situation. The result is a device where balance must be maintained and is rarely if ever assured, thus requiring constant balancing by the user, and a safety that keeps the user from tipping excessively. In practice, it is desirable for the seat to tip no more than about ten degrees from the horizontal.

Figure 5:
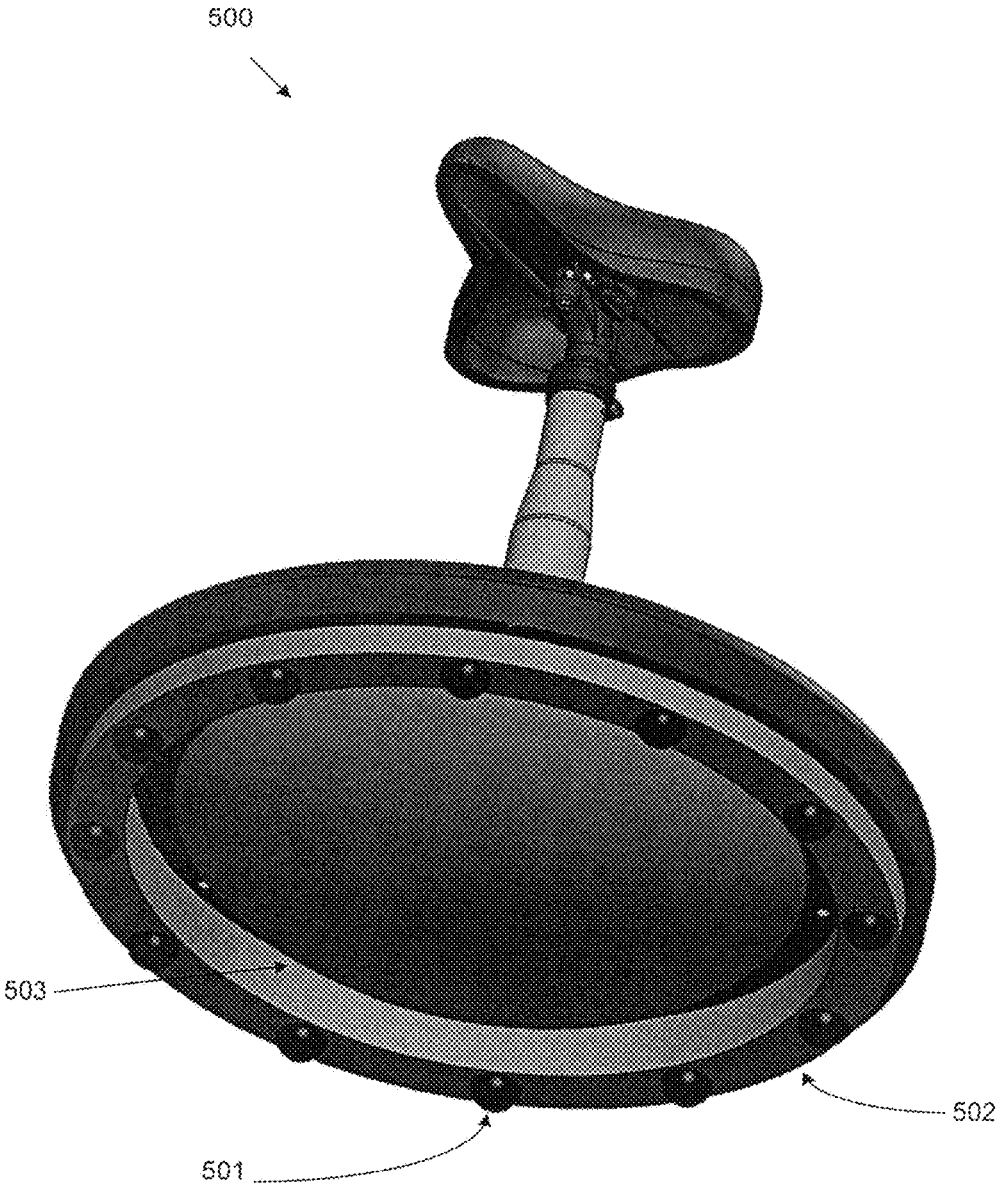
FIG. 5 shows a bottom perspective view of an embodiment of the present design including rollers.

FIG. 5 illustrates a further embodiment of a seating device 500 wherein rollers, including roller 501, are provided on the bottom edge of guard 502. Any type of moving or rolling elements may be employed, including wheels, and such elements may be detachable from the guard. In FIG. 5, the rollers including roller 501 enable the user to deflate inflatable bladder 503 and use the device in a manner similar to a conventional rolling chair. The dimensions of the inflatable bladder remain generally the same, and when inflated the inflatable bladder contacts a surface underneath with at least an inch of clearance afforded to guard 502. The embodiment of FIG. 5 may also be employed with detachable rollers or wheels, and the wheels removed if desired by the user. In this configuration, the inflatable bladder 503 may be deflated and the device used as a conventional chair. Alternately, the guard 502 may comprise a series of concentric rings and may telescope downward using pneumatics, thereby providing a non-tipping or solidly supported chair.

Figure 6:
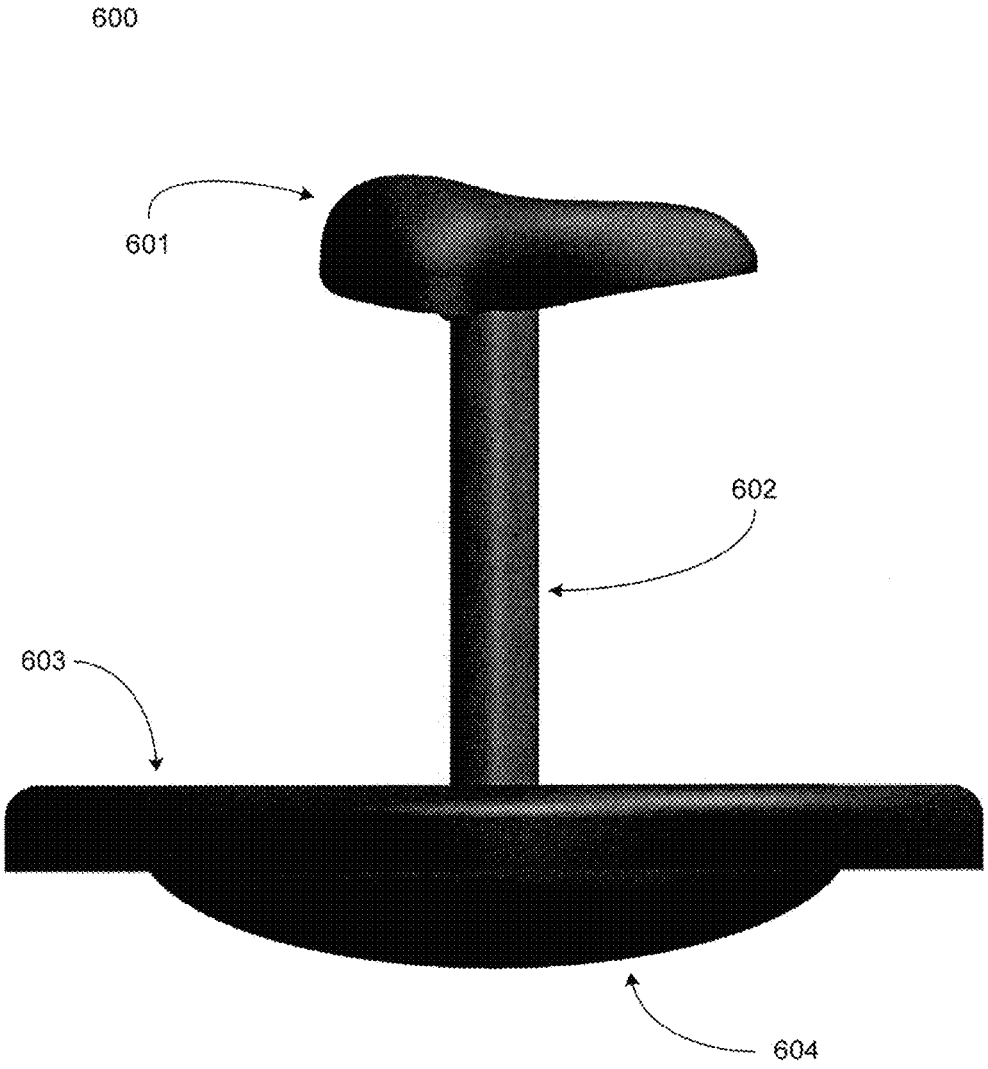
FIG. 6 illustrates a side view of an embodiment of the present design.

FIG. 6 illustrates a side view of one embodiment of the present design with the shield or guard removed. Seating device 600 includes seat 601, post 602, footrest 603, and inflatable bladder 604. Note that in this view, the ratio of the diameter of the top of the inflatable bladder 604 to the diameter of the base of the footrest 603 is approximately 70 percent. In this view, depth of the inflatable bladder to the radius of the portion of the inflatable bladder contacting the footrest is approximately 7 percent, but a larger or smaller percentage could be successfully employed, such as in the range of 5 to 10 percent. Note that a wider footrest and wider inflatable bladder could be employed, with the goal being a similar tipping limit for the seat 601. In other words, a wider footrest could be employed with a proportionately wider inflatable bladder, for example, with the depth of the inflatable bladder provided to limit tipping to within less than 30 degrees when the guard is not employed, and less than 15 degrees when the guard is employed. Note that the inflatable bladder may be filled or deflated based on user preference, altering the foregoing dimensions and relationships.

Feedback Measurement

One additional embodiment of the present design employs the teachings disclosed above in conjunction with certain sensing electronics to sense the position of the user and may assist the user in maintaining her center of gravity and/or obtaining a cardiovascular workout. In this embodiment, a data acquisition and feedback control system is integrated into the device for the purpose of monitoring a user's level of fitness and/or to provide a means to generate feedback that can be used to control gaming software or any other application requiring user controls. Alternately, controls in the device may sense user orientation and transmit signals to a receiver. The device or an external device may receive signals from the sensing electronics and may provide some type of visual or audio indication that the user is in or out of position. For example, the user may be out of position and a sound may be emitted, whereas when he achieves balance no sound is emitted, and the sound may vary in frequency or amplitude depending on proximity to a balanced position.

The device data and control system includes one or multiple single or multi-axis accelerometers and gyroscopes, and information from these devices may be provided to a memory storage device located within the device and may be transmitted by conventional devices known to those skilled in the art, such as via wireless transmission (such as Wi-Fi) capable of transmitting collected data in real time.

The accelerometers and gyroscopes measure motion and rotation of the device. The motion and rotation of the device, once measured, are used to calculate the user's stability, his performance when using the device, his fitness benefit. Motion and rotation measurements can also be used as input parameters to control a number of common devices such as gaming consoles or any other equipment requiring user input.

The accelerometer determines acceleration, and the position, velocity, and acceleration can be assessed by integrating measured acceleration. A gyroscope measures the angular rotation of the device. Both types of sensors may be used on or in the device depending on the data required or the desired use, namely the device or devices the user is interested in controlling.

The device uses a platform that can be adjusted to be more or less stable by varying the pressure in the inflatable bladder. Using the onboard sensor data, each user will have the ability to normalize her performance using the device and may compare her performance with the performance of others. Body weight, height, and bladder pressure in addition to performance can be indexed and an individual's ultimate fitness benefit can be more accurately understood.

The feedback sensors may be positioned at any reasonable location within the device, such as in post 202 or under footrest 203. They may also be positioned within seat 201 if desired. Wiring may be provided to a transmitter to transmit sensor readings to another device such as a video gaming console or simulator.

Additionally, the device disclosed herein may be fitted or provided with a balance motor, similar to those used in robotics, able to accept input or commands from a remote video game or simulator arrangement and create movement of the device that would coincide with the video game or simulator. This balance motor may be part of a "gaming seat" that may replace the seat in the embodiments disclosed above. Such a seat may require separate power, and may provide added resistance to the user, i.e. when turning right, the user feels upward pressure from the left side, and vice versa, or may cause the seat to pivot or move in a particular direction based on commands received from the simulator or game.

One such implementation may entail two angular momentum flywheels mounted perpendicular to each other on the seat or possibly the base of the chair to induce torque for a variety of applications. The angular momentum flywheel may include a motor and two flywheels. The motor can be positioned between the flywheels with a shaft extending from both sides of the motor. One flywheel is mounted on each end of the shaft. A barrier is typically provided between the flywheels and the user for safety. One flywheel per motor may also be employed. Torque from the flywheels enables the seat to introduce random disturbances, providing a cardiovascular and balancing challenge for the user. Additionally, such a device may enable the user to be moved using forces corresponding to external events, such as simulator or video game events. Force may be applied in a sideways manner when the user is driving around a corner in a car racing game, or balance may be provided when the user accomplishes a goal, or vibrations may be introduced when the user strikes an object, or is hit by a weapon in a combat game, and so forth. Further, such a design may provide an ability for the user to receive assistance, i.e. apply balancing forces when the user is unable to achieve balance.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A seating device, comprising:

a seat;

a post positioned below and attached to the seat;

a base positioned below and attached to the post;

an inflatable bladder positioned below and attached to the base;

sensing electronics configured to sense orientation of the seating device and provide orientation data to a remote computing device; and a guard attached to the base, the guard comprising a cylindrical wall centered on a longitudinal axis of the post and extending downward from the base at a position spaced radially outward from the inflatable bladder, the guard having a lower edge located above a bottom of the inflatable bladder and configured to inhibit tipping of the seat to no more than ten degrees from horizontal;

wherein the inflatable bladder comprises a complete spherical dome, wherein when the inflatable bladder is filled, a tangent line to the inflatable bladder intersects the lower edge and forms an angle of greater than or equal to about 75 degrees relative to the post.

2. The seating device of claim 1, wherein the seat comprises a padded saddle seat.

3. The seating device of claim 1, further comprising at least one sensor configured to sense positional attributes of the user.

4. The seating device of claim 1, wherein the post comprises an adjustable post comprising an inner element and an outer element.

5. The seating device of claim 1, wherein radius of curvature of the inflatable bladder is greater than 0.5 feet and less than four feet.

6. The seating device of claim 1, further comprising a bladder fill mechanism provided in the base.

7. The seating device of claim 6, wherein the bladder fill mechanism comprises a valve.

8. A seating device, comprising:

a saddle seat supported by a post;

a base positioned below and attached to the post, the base having an inflatable bladder positioned on a bottom side of the base;

sensing electronics configured to sense orientation of the seating device and provide orientation data to a remote computing device; and a guard comprising a cylindrical wall centered on a longitudinal axis of the post and extending downward from the base at a position spaced radially outward from the inflatable bladder, the guard having a lower edge located above a bottom of the inflatable bladder and configured to inhibit tipping of the seat to no more than ten degrees from horizontal;

wherein the inflatable bladder comprises a complete spherical dome, wherein when the inflatable bladder is filled, a tangent line to the inflatable bladder intersects the lower edge and forms an angle of greater than or equal to about 75 degrees relative to the post.

9. The seating device of claim 8, wherein the guard comprises a plurality of movable elements affixed thereto.

10. The seating device of claim 8, further comprising at least one sensor configured to sense positional attributes of the seating device.

11. The seating device of claim 8, wherein the post comprises an adjustable post comprising an inner element and an outer element.

12. The seating device of claim 8, wherein radius of curvature of the inflatable bladder is greater than 0.5 feet and less than four feet.

13. The seating device of claim 8, further comprising a bladder fill mechanism associated with the inflatable bladder.

14. The seating device of claim 13, wherein the bladder fill mechanism comprises a valve.

15. A seating device comprising a seat affixed to a post, the seating device comprising:

an inflatable bladder configured to be positioned proximate a horizontal surface, the inflatable bladder affixed to a base;

a guard comprising a cylindrical wall centered on a longitudinal axis of the post and extending downward from the base at a position spaced radially outward from the inflatable bladder, the guard having a lower edge located above a bottom of the inflatable bladder and configured to inhibit tipping of the seat to no more than ten degrees from horizontal; and sensing electronics configured to sense orientation of the seating device and provide orientation data to a remote computing device;

wherein the inflatable bladder comprises a complete spherical dome, wherein when the inflatable bladder is filled, a tangent line to the inflatable bladder intersects the lower edge and forms an angle of greater than or equal to about 75 degrees relative to the post.

16. The seating device of claim 15, wherein the guard comprises a plurality of movable elements affixed thereto.

17. The seating device of claim 15, further comprising at least one sensor configured to sense positional attributes of the user.

18. The seating device of claim 15, further comprising a bladder fill mechanism associated with the inflatable bladder.

19. The seating device of claim 15, further comprising a bladder fill mechanism configured to permit filling and deflating of the inflatable bladder.

20. The seating device of claim 19, wherein the bladder fill mechanism comprises a valve.

* * * * *